US005453352A

United States Patent [19]

Tachibana

[11] Patent Number: 5,453,352

[45] Date of Patent: Sep. 26, 1995

[54] SILVER HALIDE COLOR PHOTOGRAPHIC LIGHT-SENSITIVE MATERIAL

[75] Inventor: Noriki Tachibana, Hino, Japan

[73] Assignee: Konica Corporation, Japan

[21] Appl. No.: 382,573

[22] Filed: Feb. 2, 1995

Related U.S. Application Data

[63] Continuation-in-part of Ser. No. 201,531, Feb. 25, 1994, abandoned.

[30] Foreign Application Priority Data

Mar. 2, 1993 [JP] Japan ..... 5-41288

[51] Int. Cl.[6] ..... G03C 1/76

[52] U.S. Cl. ..... 430/537; 430/545; 430/546; 430/627; 430/631; 430/935; 430/531

[58] Field of Search ..... 430/545, 546, 430/627, 631, 537, 935, 531

[56] References Cited

U.S. PATENT DOCUMENTS

| | | | |
|---|---|---|---|
| 4,358,533 | 11/1982 | Tokitou et al. | 430/627 |
| 4,497,929 | 2/1985 | Brown et al. | 430/547 |
| 4,710,456 | 12/1987 | Naoi et al. | 430/631 |
| 5,047,316 | 9/1991 | Hirano et al. | 430/545 |

FOREIGN PATENT DOCUMENTS

| | | | |
|---|---|---|---|
| 0361138 | 4/1990 | European Pat. Off. | 430/631 |

*Primary Examiner*—Thomas R. Neville
*Attorney, Agent, or Firm*—Jordan B. Bierman; Bierman and Muserlian

[57] ABSTRACT

A silver halide photographic light-sensitive material is disclosed, which comprises a support and provided thereon, a hydrophilic colloid layer comprising a silver halide emulsion layer wherein the hydrophilic colloid layer contains a compound having a solubility of not less than 1 g based on 100 g of water of 25° C. represented by the following Formula (I):

$$\text{Formula (I)} \quad \leftarrow A \rightarrow_x \leftarrow B \rightarrow_y \leftarrow C \rightarrow_z$$

wherein A and B represent repeating units represented by the following Formulas (II) and (III);

Formula (II)

Formula (III)

7 Claims, No Drawings

SILVER HALIDE COLOR PHOTOGRAPHIC LIGHT-SENSITIVE MATERIAL

This Application is a Continuation-in-part of application Ser. No. 08/201,531filed Feb. 25, 1994, now Abandoned, which claims the priority of Japanese Application 41288/93, filed Mar. 2, 1993.

FIELD OF THE INVENTION

The present invention relates to a silver halide photographic light-sensitive material containing a new water-soluble binder, and more particularly to a silver halide photographic light-sensitive material wherein coating property has been improved.

BACKGROUND OF THE INVENTION

Generally, in a hydrophilic colloidal layer used in manufacturing a photographic light-sensitive material, gelatin which is solled and gels reversibly due to heating and chilling of its aqueous solution is used as a binder. However, when a high concentrated aqueous solution is coated aiming at high speed coating for the improvement of productivity, it had a shortcoming that coating unevenness due to drying air easily occurrs. In order to improve this problem, Japanese Patent Publication Open to Public Inspection (hereinafter referred to as Japanese Patent O. P. I. Publication) No. 296736/1991 discloses a technology to incorporate natural high molecular poly sugars such as coppercaraguinane and W091/15526 discloses a technology to convert thermal transition temperature of gelatin by means of a derivative of an N-substituted acryleamide. However, these technologies are still not sufficient for attaining necessary properties.

SUMMARY OF THE INVENTION

An object of the present invention is to improve the above-mentioned shortcoming which conventional water-soluble binders have, and more particularly to provide a silver halide photographic material wherein Coating properties have been improved.

An object of the invention have been attained by a silver halide photographic light-sensitive material comprising a support and provided thereon, at least one hydrophilic colloid layer containing a water soluble compound represented by the following Formula (I):

$$\text{Formula (I)} \qquad \left(A\right)_x\left(B\right)_y\left(C\right)_z$$

wherein A represents a repeating unit represented by the following Formula (II);

Formula (II)

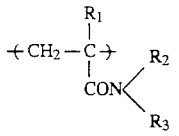

wherein $R_1$ represents a hydrogen atom or an alkyl group having 1 to 6 carbon atoms, which may have a substituent selected from a halogen atom, an alkoxy group, an acyl group, a sulfoalkyl group, a nitro group, a nitrile group or a tetrahydrofurfuryl group; $R_2$ and $R_3$ independently represent a hydrogen atom or a substituent having 1 to 20 carbon atoms or $R_2$ and $R_3$ may combine to form a ring, provided that one of $R_2$ and $R_3$ represents a group having not less than two ether bonds or a group having one tetrahydrofurfuryl group as an ether group or when $R_2$ and $R_3$ combine to form a ring, the formed ring has one or more ether bonds; B represents a unit represented by the following Formula (III);

Formula (III)

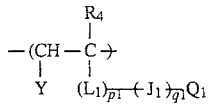

wherein $R_4$ represents a hydrogen atom, a halogen atom or an alkyl group; $L_1$ represents —CONH—, —NHCO—, —COO—, —OCO—, —SO—, —CO—or —O—; $J_1$ represents an alkylene group, an arylene group or $-(CH_2CH_2O)_m(CH_2)_n-$ wherein m represents an integer of 0 to 40 and n represents an integer of 0 to 4; $Q_1$ represents, $-SO_3M$, —OP (=O) $(OM)_2$, $R_6$,

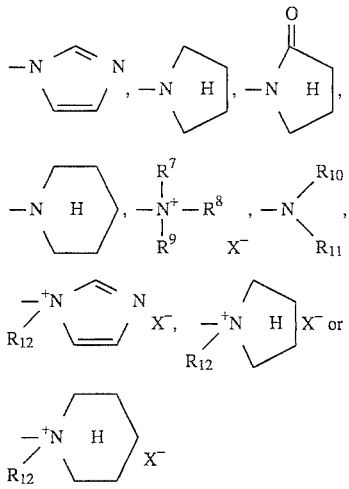

wherein M represents a hydrogen atom or a cation; $R_6$, $R_7$, $R_8$, $R_9$, $R_{10}$, $R_{11}$ and $R_{12}$ independently represent a hydrogen atom or an alkyl group having 1 to 20 carbon atoms; X represents an anion; $p_1$ and $q_1$ independently represent 0 or 1; Y represents a hydrogen atom or $$\left(L_2\right)_{p2}\left(J_2\right)_{q2}Q_2$$

wherein $L_2$, $J_2$, $Q_2$, $p_2$ and $q_2$ represent the same as $L_1$, $J_1$, $Q_1$, $p_1$ and $q_1$ in the above Formula (III), respectively, or Y may combine with $-(L_1)p_1(J_1)q_1Q_1$ to form a ring; C represents a repeating unit capable of copolymerizing with units A and B; and x is 10 to 99 mol%, and preferably 30 to 99 mol% y is 90 to 1 mol%, preferably 80 to 1 mol% and z is 0 to 70 mol%.

The compound represented by Formula (I) is a water soluble compound, and has a solubility of not less than 1 g based on 100 g of water of 25° C. The measurement of the solubility is carried out by an ordinary method, for example, the following one. A solute is dissolved in 100 g of water at 25° C. to saturate, the insoluble solute is filtered out, and then the dissolved solute is weighed. More concretely, 120 g of a compound is added to 200 g of distilled water in a 300 ml beaker and stirred while heating at 1° C./minute with a magnetic stirrer equipped with a heater. Before the compound is completely dissolved, the supernatant is placed in an evaporating dish and weighed. Then the supernatant in the evaporating dish is completely evaporated and the residue is weighed.

It is preferable in Formula (II) that $R_1$ is a hydrogen atom, a methyl group, an ethyl group or a propyl group; and $R_2$ and $R_3$ independently are a hydrogen atom, a methyl group, an ethyl group, an isopropyl group, a methoxyethoxyethyl group, a methoxymethoxyethyl group, a methoxyethoxypropyl group, a methoxyethyl group, tetrahydrofurfuryl group, an ethoxyethoxyethoxy group or a hydrocabon group having at least two ether linkages in which the sum of carbon atoms is 2 to 20.

It is preferable in Formula (III) that $R_4$ is a hydrogen atom, a methyl group, an ethyl group or a propyl group; $L_1$ is —CONH—, —NHCO—, —CO—, —OCO—, —CO— or —O——; $J_1$ is a methylene group, an ethylene group, a phenylene group or $—(CH_2CH_2O)_m—(CH_2)_n—$ wherein m represents an integer of 0 to 40 and n represents an integer of 0 to 4; $Q_1$ is $—SO_3M$, $—NH_3.Cl$, $—NH(CH_3)_2.Cl$,

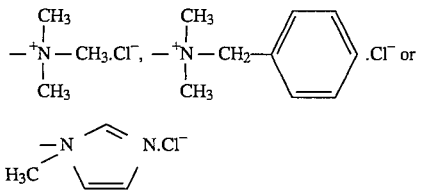

wherein M represents a hydrogen atom or a cation; and Y is a hydrogen atom.

The repeating unit (A) in Formula (I) is represented by Formula (II) and is derived from a monomer represented by the following Formula (M-II) :

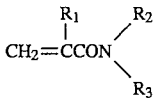

Formula (M-II)

wherein $R_1$, $R_2$ and $R_3$ represent the same as $R_1$,$R_2$ and $R_3$ in Formula (II), respectively.

Examples of monomer (M-II) is shown below, and is not limited thereto.

$CH_{2CHCONH(CH_2}CH_2O)_2CH_3$ MII-1

$CH_{2CHCONH(CH_2)_3}OCH_2CH_2OCH_3$ MII-2

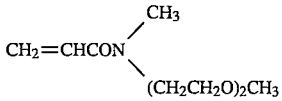

MII-3

$CH_{2CHCON(CH_2}CH_2OCH_3)_2$ MII-4

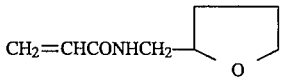

MII-5

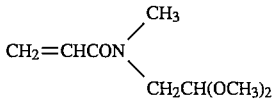

MII-6

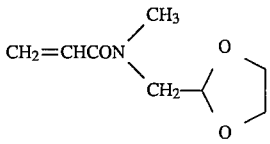

MII-7

-continued

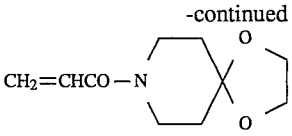

MII-8

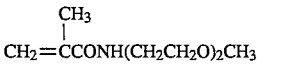

MII-9

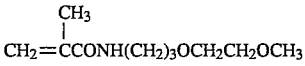

MII-10

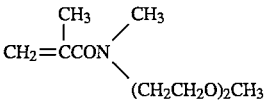

MII-11

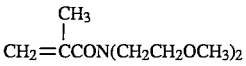

MII-12

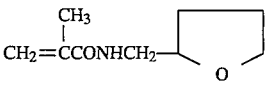

MII-13

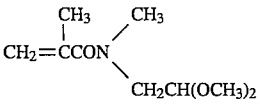

MII-14

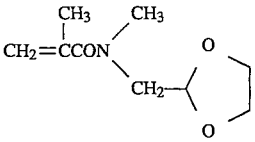

MII-15

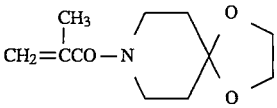

MII-16

The repeating unit (B) in Formula (I) is represented by the following formula (M-III):

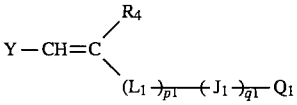

Formula (M-III)

wherein $R_4$, $L_1$, $J_1$, $W_1$, Y, $p_1$ and $q_1$ in Formula (III), respectively.

Examples of monomer (M-III) is shown below, and is not limited thereto.

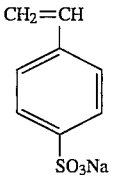

MIII-1

$CH_{2CHCOOCH_2}CH_2SO_3K$ MIII-2

-continued

MIII-3

$$CH_2{=}CHCONHC(CH_3)_2CH_2SO_3Na$$

MIII-7

$$CH_2{=}C(CH_3)CONH(CH_2)_3N^+H_3.Cl^-$$

MIII-8

$$CH_2{=}C(CH_3)CONH(CH_2)_3NH(CH_3)_2.Cl^-$$

-continued

MIII-9

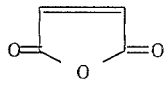

MIII-11

$$CH_2{=}C(CH_3)COO(CH_2)_3SO_3Na$$

The repeating unit (C) in Formula (I) represents a unit capable of copolymerizing with units (A) and (B). As the monomers from which repeating unit (C) is derived are preferably used acrylates, methacrylates, vinyl acetate, styrene, acrylonitrile and acrylamide.

Examples of compounds represented by Formula (I) of the invention is shown below, and x, y and z each represent molar ratio.

All of the following examples are compounds whose solubility is not less than 1 g based on 100 g of water of 25° C.

P-1

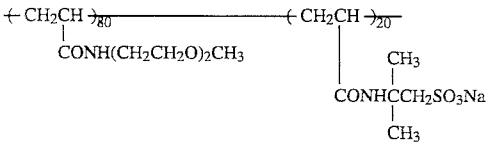

P-2

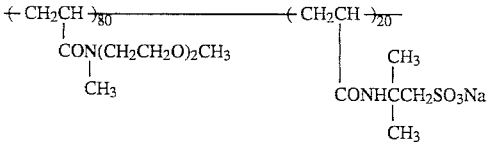

P-3

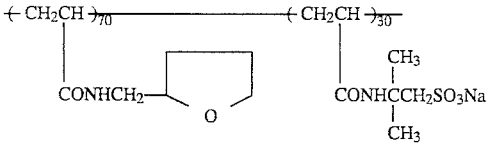

P-4

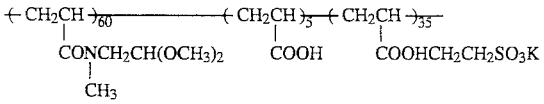

P-5

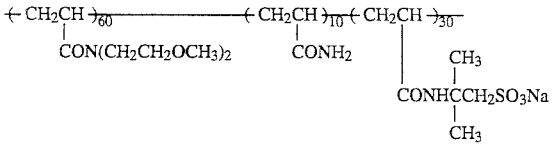

P-6

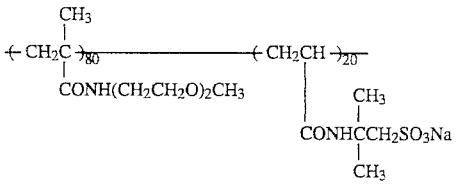

P-7

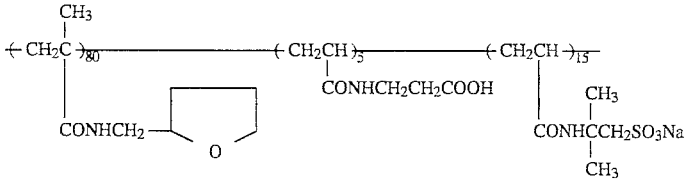

-continued

P-8

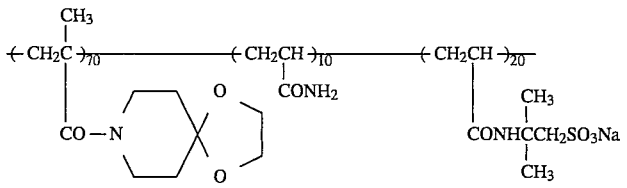

P-9

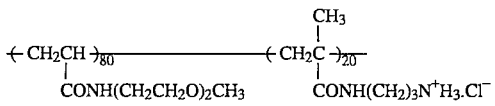

P-10

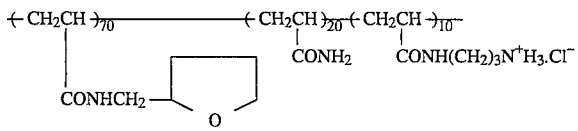

P-11

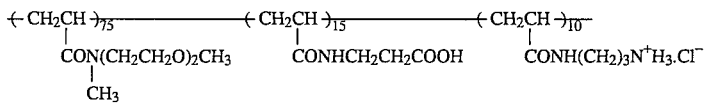

P-12

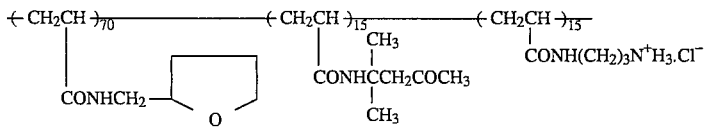

P-13

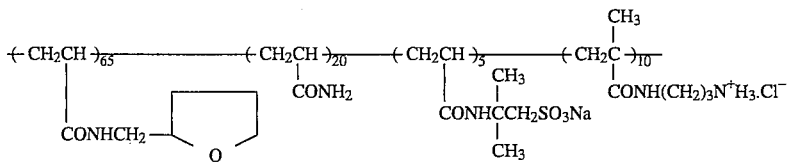

The weight average molecular weight of compounds represented by Formula (I) of the invention is 1,000 to 1,000,000, and preferably 3,000 to 500,000.

The content of the compounds of the invention in the hydrophilic colloid layer is 0.1 to 80 wt%, preferably 1 to 50 wt%, and more preferably 2 to 30 wt% based on the total binder content.

The compounds of the invention are used in all hydrophilic colloid layers of photographic light sensitive materials, for example, a silver halide emulsion layer, an intermediate layer, a protective layer, antihalation layer, a backing layer and a subbing layer.

In the present invention, as a hydrophilic colloid used in combination with compounds of the present invention, it is preferable to use gelatin and gelatin derivatives. In addition, hydrophilic colloid such as graft polymer of gelatin and other polymers, other proteins, sugar derivatives, cellulose derivatives or synthetic hydrophilic polymers can be used.

As gelatin, in addition to gelatin processed with lime, gelatin processed with oxygen and gelatin processed with enzyme can be used.

As a gelatin derivative, those wherein various compounds such as halide oxide, isocyanates, oxygen anhydride, alkane sulfones, vinylsulfonamides, maleic amides, polyalkylene oxides and epoxy compounds are reacted on gelatin described in U.S. Pat. Nos. 2,614,928, 3,132,945, 3,816,846 and 3,312,553 and Japanese Patent Publication No. 26845/1967 are cited.

As protein, albumine and casein are cited. As a cellulose derivative, hydroxyethyl cellulose, carboxymethyl cellulose and cellulose sulfate ester are preferable. As a sugar derivative, sodium alginic acid and starch derivatives are preferable.

As a graft polymer of gelatin and other polymers, those wherein vinyl monomers such as acrylic acid, methacrylic acid and their derivatives such as esters and amides, acrylonitrile and styrene are grafted on gelatin can be used. Especially, graft polymers with polymers having high compatibility with gelatin such as acrylic acid, acrylic amide, methacrylic amide and hydroxylmethacrylate are preferable. These are described in U.S. Pat. Nos. 2,763,625, 2,831,767 and 2,956,884.

As a typical synthetic hydrophilic polymer, polyvinyl alcohol, polyvinyl alcohol partial acetal, polyvinyl pyrrolidone, polyvinyl imidazole, polyvinyl pyrazole, polyacrylic acid, polymethacrylic acid and polyacrylic amide are cited. These are described in U.S. Pat. Nos. 3,620,751 and 3,879,205 and Japanese Patent Publication No. 7561/1968. It is preferable that the content of these polymers is smaller than the compounds of the present invention.

To the hydrophilic colloidal layer of the present invention, a hydrophobic latex can be added. As the latex, a copolymer of an acrylic acid ester, a methacrylic acid ester, vinyl acetate, styrene, olefin and acrylonitrile are cited. The particle size is preferably 0.03 to 0.30 μm. The content is preferably 10 to 80 wt% on a hydrophilic colloid.

The present invention is applicable to all light-sensitive materials using a hydrophilic colloidal layer including a color negative film, a reversal film, a color paper, a graphic arts film and an X-ray film.

The coating speed of the light-sensitive material of the present invention is 30. to 500 m/min, preferably 50 to 300 m/min. and more preferably 70 to 200 m/min.

The coated light-sensitive material is dried by an ordinary method. Namely, it is chilled immediately after being coated and solidified. For this reason, the light-sensitive material to be dried is brought into contact with air with low temperature such as −10° to −20° C. In the above-mentioned manner, after a coated layer is chilled and solidified, it is subjected to drying by the blowing of dry air.

In the above-mentioned drying using air, 10 to 40 $m^3/m^2$.min. of air wherein the drying temperature is 15 to 45° C. and the relative humidity is 10 to 50%RH is blown. Necessary drying time is different depending upon the amount of swelling coating and the conditions of drying. Normally, the drying time is 0.5 to 5 minutes. The temperature of the coated layer dried in the above-mentioned manner is preferably regulated by air whose drying temperature is 20° to 40° C. and whose relative humidity is 50 to 70%RH.

As a support applicable to the present invention, a paper support on which cellulose triacetate, polyethylene terephthalate or polyethylene is laminated can be used preferably.

EXAMPLES

Hereinafter, the present invention will be explained referring to examples. However, the present invention is not limited thereto.

Example 1

Preparation of a seed emulsion 1

By the use of a double jet method, an emulsion composed of a mono dispersed cubic crystal grains of silver bromoiodide containing 2 mol% of silver iodide having an average grain size of 0.3 μm was prepared while controlling temperature at 60° C., pAg at 8 and pH at 2.0. The resulting emulsion was desalted using an aqueous solution of Demol N produced by Kao Atlas and magnesium sulfate aqueous solution at 40°°. Following that, gelatin aqueous solution was added thereto to disperse again. Thus, a seed emulsion was prepared.

Growth from Seed Emulsion 1

By the use of the above-mentioned seed emulsion, grains were grown as follows. At first, the seed emulsion was dispersed in an aqueous gelatin solution kept at 40° C. Then, pH of the mixture was regulated to 9.7 with aqueous ammonia and acetic acid. To this solution, an aqueous solution of ammonia silver nitrate and an aqueous solution of potassium bromide - potassium iodide were added by the use of the double jet method. During addition, pAg was regulated at 7.3 and pH was regulated at 9.7 so that a layer wherein the silver iodide content was 35 mol%. Next, an aqueous ammonia silver nitrate solution and an aqueous potassium bromide were added thereto by the use of the double jet method. Up to 95% of the target grain size, pAg was regulated to 9.0 and pH was changed consecutively from 9.0 to 8.0. Subsequently, pH was reduced to 6.0 by the use of acetic acid. Then, to the mixture, 400 mg/mol AgX of an anhydride compound of sodium 5,5'-dichloro-9-ethyl-3,3'-di-(3-sulfopropyl)oxacarbocyanine salt (Sensitizing dye GD-1) was added. The resulting solution was subjected desalting by the use of an aqueous solution of Demol N produced by Kao Atlas and an aqueous solution of magnesium sulfate. After that, the resulting mixture was dispersed again by adding an aqueous gelatin solution.

By the use of the above-mentioned method, monodispersed silver bromoiodide emulsions (A), (B) and (C) whose average grain sizes were 0.40 μm, 0.65 μm and 1.00 μm, respectively and whose fluctuation coefficient ($\sigma/\Gamma$) were 0.17, 0.16 and 0.16, respectively wherein the average silver iodide content was 2.0 mol and their vertex were rounded were prepared.

$\sigma/\Gamma$=(Standard coefficient of grain distribution) /Average grain size Preparation of Seed Emulsion 2

To 0.05 N of potassium bromide aqueous solution containing-gelatin processed with perhydroxide stirred vigorously at 40° C., equivalent mol of potassium bromide aqueous solution containing silver nitrate aqueous solution and gelatin processed with perhydroxide were added by the use of the double jet method. After 1.5 minutes, the liquid temperature was lowered to 25° C. spending 30 minutes. Then, 80 cc of aqueous ammonia (28%) per mol of silver nitrate was added thereto and the mixture was stirred for 5 minutes.

Following that, pH was regulated to 6.0 by the use of acetic acid. The solution was desalted by the use of Demol N aqueous solution produced by Kao Atlas and magnesium sulfate aqueous solution. Then, the mixture was dispersed again after adding a gelatin aqueous solution. The resulting seed grain was a spherical grain whose average grain size was 0.23 μm and the fluctuation coefficient was 0.28.

Growth from Seed Emulsion 2

By the use of the above-mentioned seed emulsion, grains were grown as follows. To aqueous solution containing osein gelatin and disodiumpropyleneoxy disuccinate salt stirred vigorously at 75 ° , an aqueous solution of potassium bromide and potassium iodide and an aqueous solution of silver nitrate were added by the use of the double jet method. During addition, the mixture was kept at pH of 5.8 and pAg of 9.0. After completion of addition, pH was regulated to 6.0 and GD-1 was added thereto by 400 mg/mol AgX. In addition, the mixture was desalted by the use of Demol N aqueous solution produced by Kao Atlas at 40° C. Then, the resulting mixture was subjected to dispersing again after adding an aqueous gelatin solution.

By the use of the above-mentioned method, a tabular bromoiodide emulsion (D) having an average silver iodide content of 1.5 mol%, the diameter of protected area of 0.96 μm, the fluctuation coefficient of 0.25 and the aspect ratio (the diameter of projected area/thickness of grain) of 4.0 was prepared.

Preparation of Samples

To the resulting emulsions (A), (B), (C) and (D), GD-1 and an anhydride compound of a sodium 5,5'-di-(buthoxycarbonyl)-1,1'-diethyl-3,3'-di-(4 -sulfobutyl)benzimidazolocarbocyanine salt were added (200:1 by weight) by 975 mg for (A), 600 mg for (B), 390 mg for (C) and 500 mg for (D) per mol of silver halide at 55° C.

After 10 minutes, chloro aurate, sodium thiosulfate and ammonium thiocyanate were added thereto and the mixtures were subjected to chemical ripening. Potassium iodide of 200 mg per mol of silver halide was added thereto 15 minutes before the end of ripening. After that, 4-hydroxy-6-methyl-1,3,3a,7-tetrazaindene was added to, the resulting mixture by $3\times10^{-2}$ mol per mol of silver halide. Then, the mixture was dispersed in an aqueous solution containing 70 g of gelatin.

Among 4 kinds of the above-mentioned emulsions subjected to ripening, Emulsions (A), (B) and (C) were mixed under the ratio of 15:65:20 to prepare an Emulsion-I. Emulsion (D) was defined to be Emulsion-II as it was. To each of Emulsion-I and Emulsion-II, the following additives were added. The added amounts were represented by those per mol of silver halide.

| | |
|---|---|
| 1,1-dimethylol-1-bromo-1-nitromethane | 70 mg |
| t-butylcatecol | 400 mg |
| Polyvinyl pyrrolidone (the molecular weight is 10,000) | 1.0 g |
| Styrene-maleic acid anhydride copolymer | 2.5 g |
| NItrophenyl triphenyl phosphonium chloride | 50 mg |
| Ammonium 1,3-dihydroxybenzene-4-sulfonic acid | 4 g |
| Sodium 2-mercaptobenzoimidazole-5-sulfonic acid | 15 mg |
| 1-phenyl-5-mercaptotetrazole | 10 mg |
| Trimethylol propane | 10 g |
| $C_4H_9OCH_2CH(OH)CH_2N(CH_2COOH)_2$ | 60 mg |
| 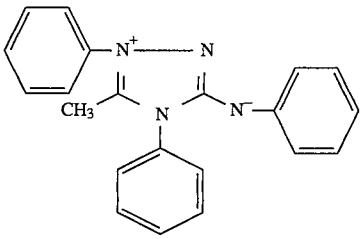 | 35 mg |

In addition, 1.2 g of the following dye dispersion solution was added thereto for preparing an emulsion coating solution.

Preparation of a dye dispersion solution

The following dye of 10 kg was dissolved in a solvent composed of 28 l of tricresylphosphate and 85 l of ethyl acetate at 55° C. This is defined to be an oil solution. In addition, 270 l of a 9.3% gelatin aqueous solution containing 1.35 kg of anionic surfactant (SU-1) was prepared. This is defined to be a water solution. Next, the oil solution and the water solution were poured in a dispersion tank. While keeping the liquid temperature at 40° C., the mixture was dispersed.

To the resulting dispersed solution, suitable amount of phenol and 1,1'-dimethylol-l-bromo-l-nitromethane were added. Water was added thereto for preparing 240 kg of the dye dispersion solution.

SU-1; Sodium tri-i-propyl naphthalene sulfonic acid

Dye

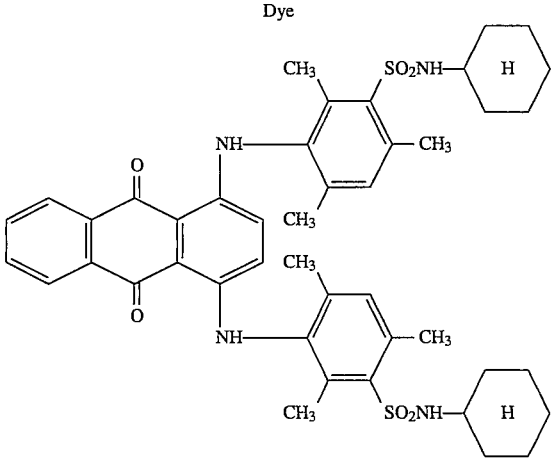

Incidentally, additives used for the solution for protective layer are as follows. The added amounts are represented by those per 1 liter of the coating solution.

| | |
|---|---|
| Inert gelatin processed with lime | 68 g |
| Gelatin processed with oxygen | 2 g |
| Sodium sulfosucceinic acid-i-amyl decyl | 0.3 g |
| Polymetylmethacrylate (a matting agent having an average grain size of 3.5 μm) | 1.1 g |
| Silica dioxide grain (a matting agent having an average grain size of 1.2 μm) | 0.5 g |
| Ludox AM (Colloidal silica: produced by Du Pont) | 30 g |
| 40% aqueous solution of Gyoxal (a hardener) | 1.5 cc |
| Di(vinylsulfonylmethyl)ether (a hardener) | 500 mg |
| $C_{12}H_{25}CONH(CH_2CH_2O)_5H$ | 2.0 g |
| Sodium 2,4-dinonyl phenoxy dodecaethylene oxy sulfonic acid | 1.0 g |
| Disodium 2,4-dinonyl phenoxy dodecaethylene oxy sulfosuccinic acid | 0.5 g |

Incidentally, an emulsion layer whose added amount was 1.7 g/m$^2$ in conversion to silver and a protective layer whose added amount of gelatin was 0.99 g/m$^2$ were coated simultaneously at the speed of 80 m/min. on a polyethylene tetephthalate base having a thickness of 175 μm coated with a copolymer aqueous dispersant wherein glycidyl methacrylate methylacrylate butylmethacrylate copolymer (50:10:40 wt%) was diluted so that the density becomes 10 wt% as a subbing solution, and dried for 2 min. and 15 sec. Thus, a comparative sample 1 was obtained.

Next, 14 kinds of samples were prepared wherein the gelatin was replaced as shown in Table 1 by the compounds of the present invention and comparative polymers. On this occasion, coating was conducted in 100 and 120 m/min. The coatability was checked visually. In addition, the coating solution of Comparative sample 4 was coated at the same speed. The coatability was also checked visually. The results are shown in Table 2.

TABLE 1

| Sample No. | Compound used | Amount (wt % on GEL) | Coating speed (m/min.) 80 | 100 | 120 |
|---|---|---|---|---|---|
| Comparative 1 | — | — | o | X | X |

TABLE 1-continued

| Sample No. | Compound used | Amount (wt % on GEL) | Coating speed (m/min.) 80 | 100 | 120 |
|---|---|---|---|---|---|
| Invention 1 | P-1 | 5 | ○ | ○ | Δ |
| Invention 2 | P-1 | 8 | ○ | ○ | ○ |
| Invention 3 | P-3 | 5 | ○ | ○ | ○ |
| Invention 4 | P-3 | 10 | ○ | ○ | ○ |
| Invention 5 | P-5 | 5 | ○ | ○ | Δ |
| Invention 6 | P-5 | 8 | ○ | ○ | ○ |
| Invention 7 | P-7 | 5 | ○ | ○ | ○ |
| Invention 8 | P-7 | 10 | ○ | ○ | ○ |
| Invention 9 | P-9 | 5 | ○ | ○ | Δ |
| Invention 10 | P-9 | 10 | ○ | ○ | ○ |
| Invention 11 | P-10 | 5 | ○ | ○ | ○ |
| Invention 12 | P-10 | 10 | ○ | ○ | ○ |
| Comparative 2 | CP-1 | 10 | ○ | Δ | X |
| Comparative 3 | CP-2 | 10 | ○ | Δ | X |

○: Even coating
Δ: Unevenness was observed partially
X: Unevenness was observed throughout the surface

CP-1

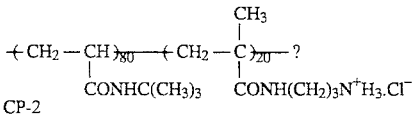

CP-2

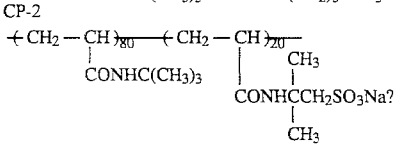

CP-1 and CP-2 are compounds whose solubility is not less than 1 g based on 100 g of water of 25° C. (Both are compounds described in the examples of W091/15526)

The effect of the present invention is distinct.

Example 2

On one side (surface) of triacetyl cellulose film support, a subbing layer was provided. Next, on the opposite side (rear) of the support of the above-mentioned surface provided with the subbing layer, layers having the following composition were coated in this order from the support side.

| | |
|---|---|
| First rear layer | |
| Alumina sol AS-100 (aluminum oxide) produced by Nissan Kagaku Co., Ltd.) | 0.8 g/m$^2$ |
| Second rear layer | |
| Diacetylcellulose | 100 mg/m$^2$ |
| Stearic acid | 10 mg/m$^2$ |
| Silica fine grain (the average grain size is 0.2 μm) | 50 mg/m$^2$ |

On a triacetyl cellulose film support, each layer having the following constitution was coated in this order from the support side so that a multilayer color photographic light-sensitive material comparative sample No.4 was prepared.

Incidentally, the added amounts of the multilayer color photographic light-sensitive material represent the number of grams per 1 m$^2$ unless otherwise specified. In addition, silver halide and colloidal silver are represented in conversion to silver, and sensitizing dyes are represented by mol number per mol of silver.

| <Emulsion Layers> | |
|---|---|
| 1st layer: antihalation layer HC | |
| Black colloidal silver | 0.15 |
| UV absorbent UV-1 | 0.20 |
| Compound CC-1 | 0.02 |
| High boiling solvent Oil-1 | 0.20 |
| High boiling solvent Oil-2 | 0.20 |
| Gelatin | 1.60 |
| 2nd layer: intermediate layer IL-1 | |
| Gelatin | 1.30 |
| 3rd layer: low-speed red-sensitive emulsion layer R-L | |
| Silver iodobromide emulsion (average grain size: 0.3 μm, average iodide content: 2.0 mol %) | 0.4 |
| Silver iodobromide emulsion (average grain size: 0.4 μm, average iodide content: 8.0 mol %) | 0.3 |
| Sensitizing dye S-1 | $3.2 \times 10^{-4}$ |
| Sensitizing dye S-2 | $3.2 \times 10^{-4}$ |
| Sensitizing dye S-3 | $0.2 \times 10^{-4}$ |
| Cyan coupler C-1 | 0.50 |
| Cyan coupler C-2 | 0.13 |
| Colored cyan coupler CC-1 | 0.07 |
| DIR compound D-1 | 0.006 |
| DIR compound D-2 | 0.01 |
| High boiling solvent Oil-1 | 0.55 |
| Gelatin | 1.00 |
| 4th layer: high-speed red-sensitive emulsion layer RH | |
| Silver iodobromide emulsion (average grain size: 0.7 μm, average iodide content: 7.5 mol %) | 0.9 |
| Sensitizing dye S-1 | $1.7 \times 10^{-4}$ |
| Sensitizing dye S-2 | $1.6 \times 10^{-4}$ |
| Sensitizing dye S-3 | $0.1 \times 10^{-4}$ |
| Cyan coupler C-2 | 0.23 |
| Colored cyan coupler CC-1 | 0.03 |
| DIR compound D-2 | 0.02 |
| High boiling solvent Oil-1 | 0.25 |
| Gelatin | 1.00 |
| 5th layer: intermediate layer IL-2 | |
| Gelatin | 0.80 |
| 6th layer: low-speed green-sensitive emulsion layer GL | |
| Silver iodobromide emulsion (average grain size: 0.4 μm, average iodide content: 8.0 mol %) | 0.6 |
| Silver iodobromide emulsion (average grain size: 0.3 μm, average iodide content: 2.0 mol %) | 0.2 |
| Sensitizing dye S-4 | $6.7 \times 10^{-4}$ |
| Sensitizing dye S-5 | $0.8 \times 10^{-4}$ |
| Magenta coupler M-1 | 0.17 |
| Magenta coupler M-2 | 0.43 |
| Colored magenta coupler CM-1 | 0.10 |
| DIR compound D-3 | 0.02 |
| High boiling solvent Oil-2 | 0.70 |
| Gelatin | 1.00 |
| 7th layer: high-speed green-sensitive layer GH | |
| Silver iodobromide emulsion (average grain size: 0.7 μm, average iodide content: 7.5 mol %) | 0.90 |
| Sensitizing dye S-6 | $1.1 \times 10^{-4}$ |
| Sensitizing dye S-7 | $2.0 \times 10^{-4}$ |
| Sensitizing dye S-8 | $0.3 \times 10^{-4}$ |
| Magenta coupler M-1 | 0.30 |
| Magenta coupler M-2 | 0.13 |
| Colored magenta coupler CM-1 | 0.04 |
| DIR compound D-3 | 0.004 |
| High boiling solvent Oil-2 | 0.35 |
| Gelatin | 1.00 |
| 8th layer: yellow filter layer YC | |
| Yellow colloidal silver | 0.10 |
| Additive HS-1 | 0.07 |

-continued

| <Emulsion Layers> | |
|---|---|
| Additive HS-2 | 0.07 |
| Aeditive SC-1 | 0.12 |
| High boiling solvent Oil-2 | 0.15 |
| Gelatin | 1.00 |
| 9th layer: low-speed blue-sensitive emulsion layer BL | |
| Silver iodobromide emulsion (average grain size: 0.3 μm, average iodide content: 2.0 mol %) | 0.25 |
| Silver iodobromide emulsion (average grain size: 0.4 μm, average iodide content: 8.0 mol %) | 0.25 |
| Sensitizing dye S-9 | $5.8 \times 10^{-4}$ |
| Yellow coupler Y-1 | 0.60 |
| Yellow coupler Y-2 | 0.32 |
| DIR compound D-1 | 0.003 |
| DIR compound D-2 | 0.006 |
| High boiling solvent Oil-2 | 0.18 |
| Gelatin | 1.30 |
| 10th layer: high-speed blue-sensitive emulsion layer BH | |
| Silver iodobromide emulsion (average grain size: 0.8 μm, average iodide content: 8.5 mol %) | 0.50 |
| Sensitizing dye S-10 | $3.0 \times 10^{-4}$ |
| Sensitizing dye S-11 | $1.2 \times 10^{-4}$ |
| Yellow coupler Y-1 | 0.18 |
| Yellow coupler Y-2 | 0.10 |
| High boiling solvent Oil-2 | 0.05 |
| Gelatin | 1.00 |
| 11th layer: 1st protective layer PRO-1 | |
| UV absorbent UV-1 | 0.07 |

-continued

| <Emulsion Layers> | |
|---|---|
| UV absorbent UV-2 | 0.10 |
| Additive HS-1 | 0.20 |
| Additive HS-2 | 0.10 |
| High boiling solvent Oil-1 | 0.07 |
| High boiling solvent Oil-3 | 0.07 |
| Gelatin | 0.80 |
| 12th layer: 2nd protective layer PRO-2 | |
| Compound A | 0.04 |
| Compound B | 0.004 |
| Methyl methacrylate:ethyl methacrylate:methacrylic acid 3:3:4 (weight ratio) copolymer (average grain size: 3 μm) | 0.13 g |
| Polymethyl methacrylate (average grain size: 3 μm) | 0.02 |
| Gelatin | 0.70 |

In addition to the above components, photographic light-sensitive materials 1 to 5 contained compounds Su-1 and Su-2, a viscosity regulator, hardeners H-1 and H-2, stabilizer 4-hydroxy-6-methyl-l,3,3a,7-tetrazaindene (ST-1), antifoggants 1-phenyl-5-mercaptotetrazole (AF-1) and AF-2 (weight average molecular weights were 10,000 and 1,100,000, respectively), dyes AI-1 and AI-2, and compound DI-1 (9.4 mg/m2).

The chemical structures of the compounds used in the above light-sensitive materials were as follows:

| | |
|---|---|
| Oil-1: | dioctylphthalate |
| Oil-2: | Tricrezylphosphate |
| Oil-3: | Dibutylphthalate |
| HS-1: | Hydantoine |
| HS-2: | 5-Ureido hydantoine |
| AF-2: | Poly-N-vinyl pyrrolidone |
| SU-2: | Sodium dioctyl sulfosuccinic acid |
| H-1: | Sodium 2,4-dichloro-6-hydroxy-s-triazine |
| H-2: | Di(vinylsulfomethyl)ether |

C-1

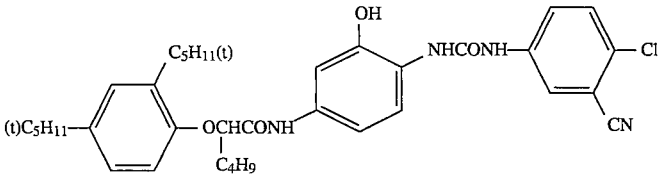

C-2

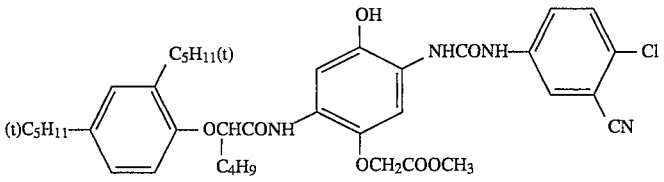

-continued
M-1
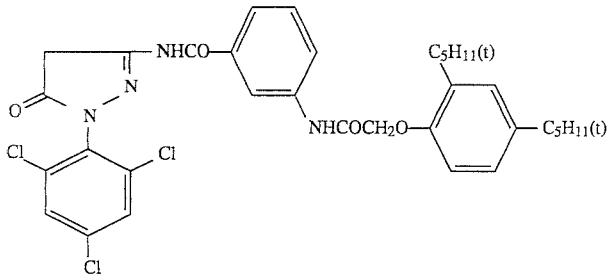
M-2
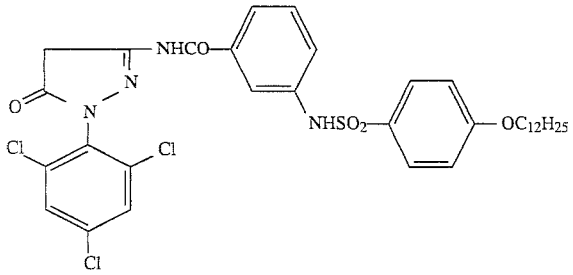
CM-1
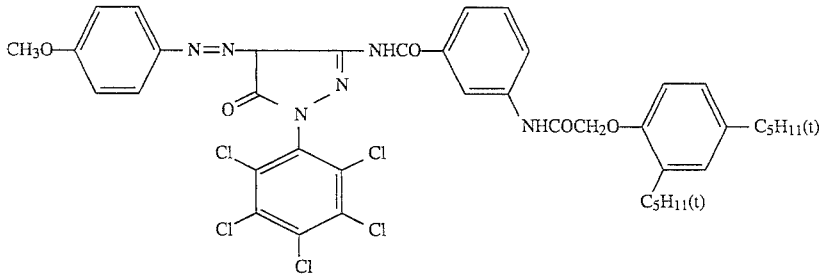
Y-1
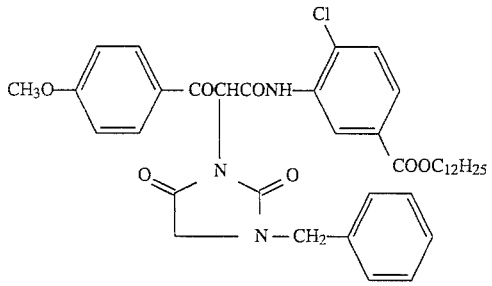
Y-2
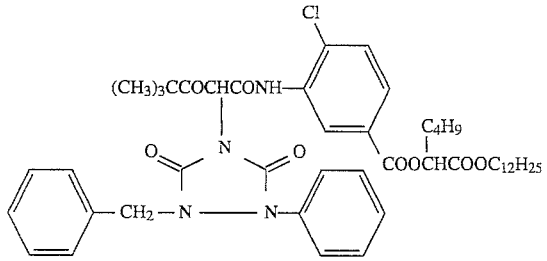

-continued
CC-1
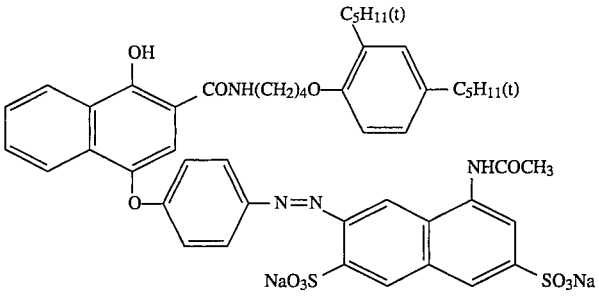
D-1
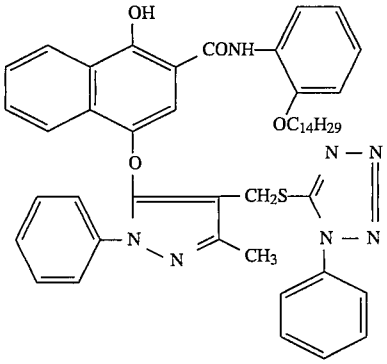
D-2
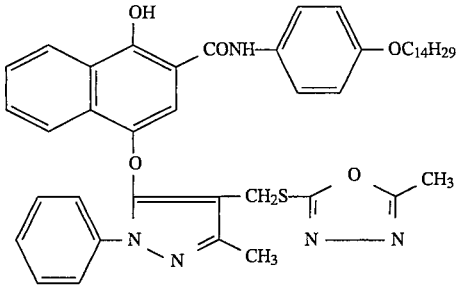
D-3
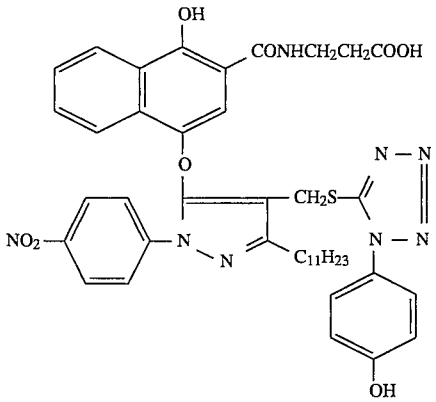
UV-1
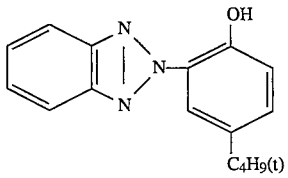

-continued
UV-2
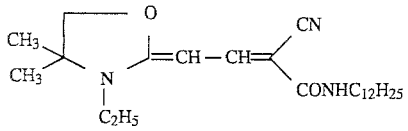
S-1
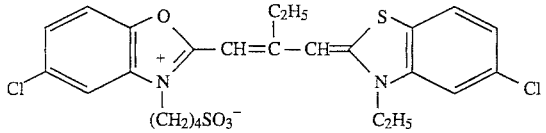
S-2
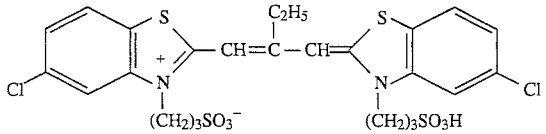
S-3
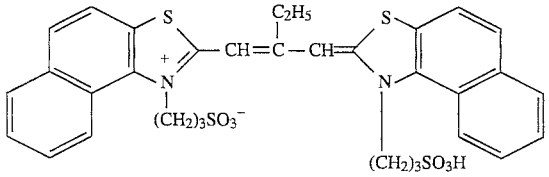
S-4
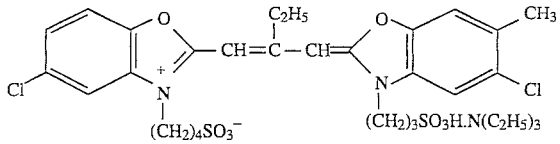
S-5
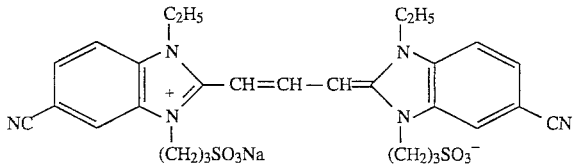
S-6
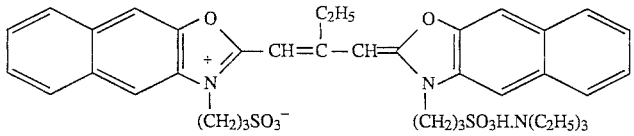
S-7
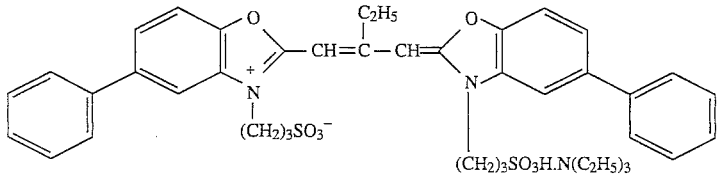
S-8
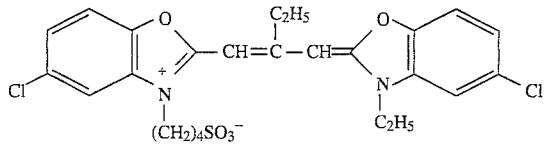
S-9
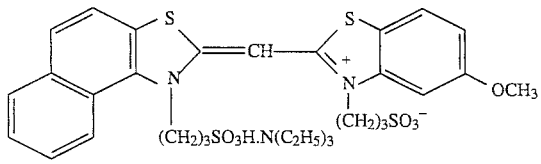

-continued

S-10

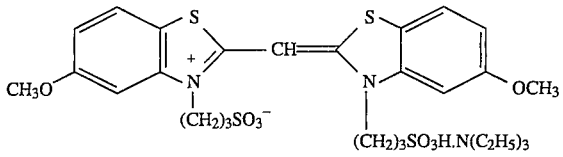

S-11

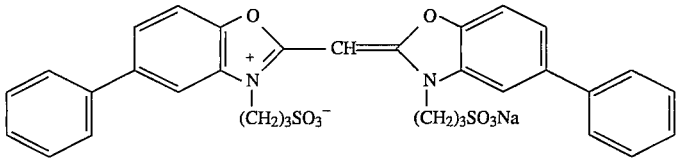

AI-1

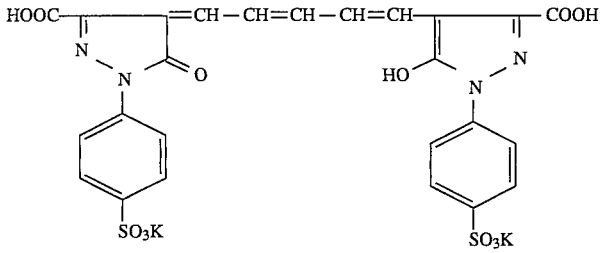

AI-2

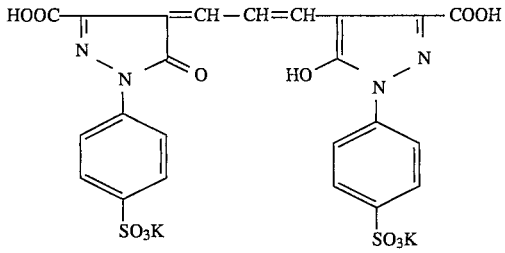

SC-1

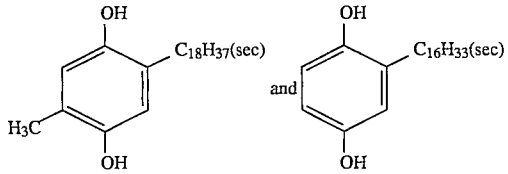

(mixture of 2:3)

WAX-1

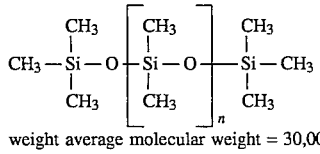

weight average molecular weight = 30,000

SU-3

$NaO_3S-CH(CH_2-COOCH_2(CF_2CF_2)_3H)-COOCH_2(CF_2CF_2)_3H$ weight average molecular weight = 1300

DI-1

(A mixture of the following three components)

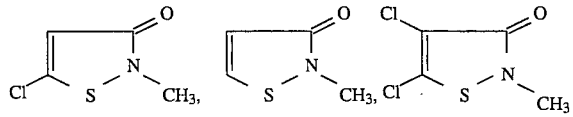

Component A Component B Component C component A:component B:component C = 50:46:4 (mole ratio)

Next, 13 kinds of samples were prepared wherein the gelatin of each layer was replaced as shown in Table 2 by the compounds of the present invention and comparative polymers.

On this occasion, coating was conducted in 80, 100 and 120 m/min. The finish of coating was checked visually. In addition, the coating solution of Comparative sample 4 was coated at the same speed. The finish of coating was also checked visually. The results are shown in Table 2.

TABLE 2

| Sample No. | Compound used | Amount (wt % on GEL) | Coating speed (m/min.) 80 | 100 | 120 |
|---|---|---|---|---|---|
| Comparative 4 | — | — | ○ | X | X |
| Invention 13 | P-1 | 10 | ○ | ○ | ○ |
| Invention 14 | P-1 | 15 | ○ | ○ | ○ |
| Invention 15 | P-2 | 5 | ○ | ○ | ○ |
| Invention 16 | P-2 | 8 | ○ | ○ | ○ |
| Invention 17 | P-3 | 5 | ○ | ○ | ○ |
| Invention 18 | P-3 | 10 | ○ | ○ | ○ |
| Invention 19 | P-7 | 5 | ○ | ○ | Δ |
| Invention 20 | P-7 | 8 | ○ | ○ | ○ |
| Invention 21 | P-11 | 5 | ○ | ○ | Δ |
| Invention 22 | P-11 | 8 | ○ | ○ | ○ |
| Comparative 5 | CP-1 | 10 | ○ | Δ | X |
| Comparative 6 | CP-2 | 10 | ○ | Δ | Δ |
| Comparative 7 | CP-3 | 10 | ○ | Δ | X |

The evaluation standard is the same as in Table 1.

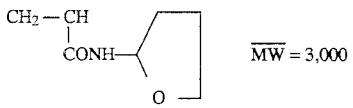

CP-3

$\overline{MW} = 3{,}000$

CP-3 is a compound whose solubility is not-less than 1 g based on 100 g of water of 25° C.

From the results shown in Table 2 too, it is apparent that the samples of the present invention is excellent.

What is claimed is:

1. A silver halide photographic light-sensitive material comprising a support and provided thereon, a hydrophilic colloid layer comprising a silver halide emulsion layer, wherein said hydrophilic colloid layer contains a compound having a solubility of not less than 1 g based on 100 g of water of 25° C. represented by the following Formula (I):

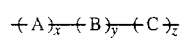

Formula (I)

wherein

A represents a repeating unit represented by the following Formula (II);

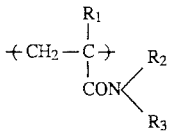

Formula (II)

wherein $R_1$ represents a hydrogen atom or an alkyl group having 1 to 6 carbon atoms; $R_2$ and $R_3$ independently represent a hydrogen atom or a substituent having 1 to 20 carbon atoms or $R_2$ and $R_3$ may combine to form a ring, provided that one of $R_2$ and $R_3$ represents a group having not less than two ether bonds or a group having one tetrahydrofurfuryl group as an ether group or when $R_2$ and $R_3$ combine to form a ring, the formed ring has one or more ether bonds;

B represents a unit represented by the following Formula (III);

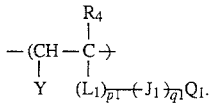

Formula (III)

wherein $R_4$ represents a hydrogen atom, a halogen atom or an alkyl group; $L_1$ represents —CONH—, —NHCO—, —COO—, —OCO—, —SO—, —CO— or —O—; $J_1$ represents an alkylene group, an arylene group or $—(CH_2CH_2O)_m(CH_2)_n—$ wherein m represents an integer of 0 to 40 and n represents an integer of 0 to 4; $Q_1$ represents $—SO_3M$, $—OP(=O)(OM)_2$, $R_6$,

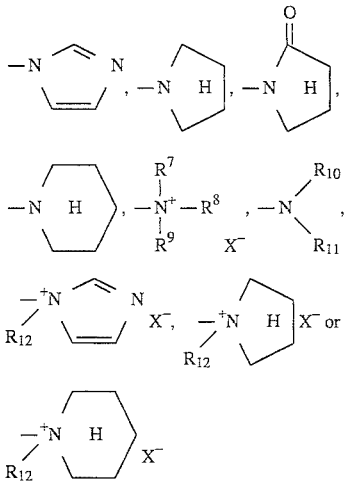

wherein M represents a hydrogen atom or a cation, $R_6$, $R_7$, $R_8$, $R_9$, $R_0$, $R_{11}$ and $R_{12}$ independently represent a hydrogen atom or an alkyl group having 1 to 20 carbon atoms, X represents an anion, and $P_1$ and $q_1$ independently represent 0 or 1; Y represents a hydrogen atom or

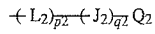

wherein $L_2$ represents —CONH—, —NHCO—, —COO—, —OCO—, —SO—, —CO— or —O—; $J_2$ represents an alkylene group, an arylene group or $—(CH_2CH_2O)_m(CH_2)_n—$ wherein m represents an integer of 0 to 40 and n represents an integer of 0 to 4; $Q_2$ represents $—SO_3M$, $—OP(=O)(OM)_2$, $R_6$,

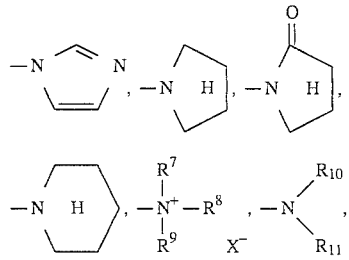

-continued

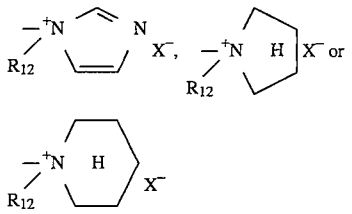

wherein M represents a hydrogen atom or a cation, $R_6$, $R_7$, $R_8$, $R_9$, $R_{10}$, $R_{11}$ and $R_{12}$ independently represent a hydrogen atom or an alkyl group having 1 to 20 carbon atoms, X represents an anion, and $p_2$ and $q_2$ independently represent 0 or 1 or Y may combine with $—(L_1)_{p1}(J_1)_{q1}Q_1$ to form a ring; C represents a repeating unit other than units A and B; and x is 10 to 99 mol %, y is 90 to 1 mol %, and z is 0 to 70 mol %.

2. The material of claim 1, wherein in Formula (II) $R_1$ represents a hydrogen atom, a methyl group, an ethyl group, or a propyl group; $R_2$ and $R_3$ independently represent a hydrogen atom, a methyl group, an ethyl group, or an isopropyl group, a methoxyethoxyethyl group, a methoxymethoxyethyl group, a methoxyethoxypropyl group, a methoxyethyl group, tetrahydrofurfuryl group, an ethoxyethoxyethoxy group or a hydrocabon group having at least two ether linkages in which the sum of carbon atoms is 2 to 20; and in Formula (III) $R_4$ represents a hydrogen atom, a methyl group, an ethyl group or a propyl group; $L_1$ represents —CONH—, —NHCO—, —COO—, —OCO—, —CO— or —O—; $J_1$ represents a methylene group, an ethylene group, a phenylene group or $—(CH_2CH_2O)_m—(CH_2)_n—$ wherein m represents an integer of 0 to 40 and n represents an integer of 0 to 4, $Q_1$ represents $—SO_3M$, —COOH, $—NH_3.Cl$, $—NH(CH_3)_2.Cl$,

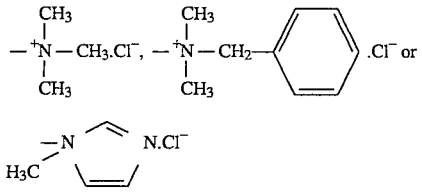

wherein M represents a hydrogen atom or a cation; $p_1$ and $q_1$ independently represent 0 or 1; and Y represents a hydrogen atom.

3. The material of claim 1, wherein in Formula (II) $R_1$ represents a hydrogen atom or a methyl group; $R_2$ and $R_3$ independently represent a hydrogen atom, $—CH_2CH_2OCH_3$, $—(CH_2CH_2O)_2CH_3$, $—CH_2(CH_2CH_2O)_2CH_3$, $—CH_2CH(OCH_3)_2$, a tetrafurfuryl group, a dioxolanylmethyl group or a tetrahydrofurfuryl group; and in Formula (III) $R_4$ represents a hydrogen atom or a methyl group; $L_1$ represents —CONH—, —COO— or —CO—; $J_1$ represents an ethylene group, a trimethylene group or a phenylene group; $Q_1$ represents $—SO_3M$, $—NH_3.Cl$ or $—NH(CH_3)_2.Cl$ wherein M represents a hydrogen atom or an alkali atom; $p_1$ and $q_1$ independently represent 0 or 1; and Y represents a hydrogen atom.

4. The material of claim 1, wherein in Formula (I) x is 30 to 99 mol %, y is 80 to 1 mol % and z is 0 to 70 mol %.

5. The material of claim 2, wherein in Formula (I) x is 30 to 99 mol %, y is 80 to 1 mol % and z is 0 to 70 mol %.

6. A silver halide photographic light-sensitive material comprising a support and provided thereon, a hydrophilic colloid layer comprising a silver halide emulsion layer, wherein said hydrophilic colloid layer comprises gelatin and a compound in an amount of 1 to 50% by weight based on the gelatin content, said compound having a solubility of not less than 1 g based on 100 g of water of 25° C. and being represented by the following Formula (I):

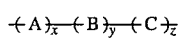

Formula (I)

wherein

A represents a repeating unit represented by the following Formula (II);

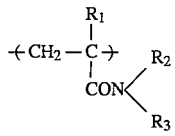

Formula (II)

wherein $R_1$ represents a hydrogen atom or an alkyl group having 1 to 6 carbon atoms; $R_2$ and $R_3$ independently represent a hydrogen atom or a substituent having 1 to 20 carbon atoms or $R_2$ and $R_3$ may combine to form a ring, provided that one of $R_2$ and $R_3$ represents a group having not less than two ether bonds or a group having one tetrahydrofurfuryl group as an ether group or when $R_2$ and $R_3$ combine to form a ring, the formed ring has one or more ether bonds;

B represents a unit represented by the following Formula (III)

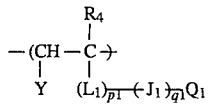

Formula (III)

wherein $R_4$ represents a hydrogen atom, a halogen atom or an alkyl group; $L_1$ represents —CONH—, —NHCO—, —COO—, —OCO—, —SO—, —CO— or —O—; $J_1$ represents an alkylene group, an arylene group or $—(CH_2CH_2O)_m(CH_2)_n—$ wherein m represents an integer of 0 to 40 and n represents an integer of 0 to 4; $Q_1$ represents $—SO_3M$, $—OP(=O)(OM)_2$, $R_6$,

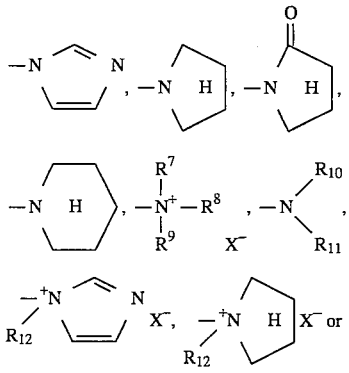

-continued

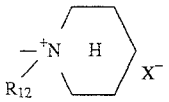

wherein M represents a hydrogen atom or a cation, $R_6$, $R_7$, $R_8$, $R_9$, $R_{10}$, $R_{11}$ and $R_{12}$ independently represent a hydrogen atom or an alkyl group having 1 to 20 carbon atoms, X represents an anion, and Pl and ql independently represent 0 or 1; Y represents a hydrogen atom or $$\text{-}(L_2)_{p2}\text{-}(J_2)_{q2}Q_2$$

wherein $L_2$ represents —CONH—, —NHCO—, —COO—, —OCO—, —SO—, —CO— or —O—; $J_2$ represents an alkylene group, an arylene group or $—(CH_2CH_2O)_m(CH_2)_n—$ wherein m represents an integer of 0 to 40 and n represents an integer of 0 to 4; $Q_2$ represents $—SO_3M$, $—OP(=O)(OM)_2$, $R_6$,

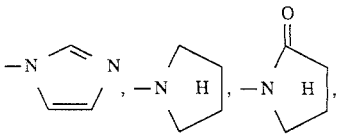

-continued

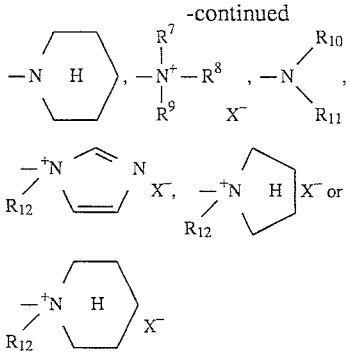

wherein M represents a hydrogen atom or a cation, $R_6$, $R_7$, $R_8$, $R_9$, $R_{10}$, $R_{11}$and $R_{12}$ independently represent a hydrogen atom or an alkyl group having 1 to 20 carbon atoms, X represents an anion, and $P_2$ and $q_2$ independently represent 0 or 1 or Y may combine with $—(L_1)_{p1}(J_1)_{q1}Q_1$ to form a ring;

C represents a repeating unit other than units A and B; and x is 10 to 99 mol %, y is 90 to 1 mol %, and z is 0 to 70 mol %.

7. The material of claim 6, wherein said hydrophilic colloid layer comprises said compound in an amount of 2 to 30 % by weight based on the gelatin content.

* * * * *